US009368926B2

(12) United States Patent
Kao et al.

(10) Patent No.: US 9,368,926 B2
(45) **Date of Patent: *Jun. 14, 2016**

(54) ELECTRICAL CONNECTOR PLUG AND CONDUCTIVE WIRE AND ASSEMBLY PROVIDED WITH THE SAME

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Wen-Yu Wang, New Taipei (TW); Wen-Hsien Tsai, New Taipei (TW); Alan Robert MacDougall, Beaverton, OR (US)

(73) Assignee: ADVANCED-CONNECTEK INC., New Taipei (TW)

( * ) Notice: Subject to any disclaimer, the term of this patent is extended or adjusted under 35 U.S.C. 154(b) by 166 days.

This patent is subject to a terminal disclaimer.

(21) Appl. No.: 14/280,646

(22) Filed: May 18, 2014

(65) Prior Publication Data

US 2015/0111430 A1 Apr. 23, 2015

(30) Foreign Application Priority Data

Oct. 18, 2013 (TW) ..... 102137770 A

(51) Int. Cl.

| | |
|---|---|
| ***H01R 9/03*** | (2006.01) |
| ***H01R 24/60*** | (2011.01) |
| ***H01R 13/6582*** | (2011.01) |
| ***H01R 13/6592*** | (2011.01) |

(52) U.S. Cl.

CPC ..... *H01R 24/60* (2013.01); *H01R 13/6582* (2013.01); *H01R 13/6592* (2013.01)

(58) Field of Classification Search

CPC ..... H01R 13/658; H01R 13/65802
USPC ..... 439/607.56, 607.55
See application file for complete search history.

(56) References Cited

U.S. PATENT DOCUMENTS

| | | | | |
|---|---|---|---|---|
| 7,909,653 | B1 * | 3/2011 | Wan | H01R 13/514 439/660 |
| 2006/0183380 | A1 * | 8/2006 | Tsai | H01R 13/5804 439/676 |
| 2010/0068903 | A1 * | 3/2010 | Chiang | H01R 12/725 439/79 |
| 2010/0278490 | A1 * | 11/2010 | Liao | G02B 6/3817 385/90 |
| 2011/0070778 | A1 * | 3/2011 | Wan | H01R 13/514 439/660 |

(Continued)

*Primary Examiner* — Abdullah Riyami
*Assistant Examiner* — Nader J Alhawamdeh

(57) ABSTRACT

An electrical connector plug having resilient contact terminals electrically connects to an electrical connector socket with a casing and two groups of engaging terminals mounted on or in the casing. The electrical connector plug has an electrically conductive housing. A coupling device extends in a longitudinal direction and has a base portion. The resilient contact terminals are mounted on the coupling device axially symmetrically arranged with each other in the longitudinal direction, each of which has a flat section and an upwardly protruding contact section. A metallic shield frame is electrically connected to and secured to the electrically conductive housing, having a frame section, a front section, and two lateral protective sections. The respective lateral protective sections have a height no less than that of the upwardly protruding contact sections of the resilient contact terminals.

10 Claims, 9 Drawing Sheets

(56) References Cited

U.S. PATENT DOCUMENTS

2012/0045943 A1* 2/2012 Huber ..... H01R 13/6593
439/660
2015/0072557 A1* 3/2015 Kamei ..... H01R 24/60
439/607.02
2015/0072565 A1* 3/2015 Golko ..... H01R 43/205
439/676
2015/0111425 A1* 4/2015 Kao ..... H01R 13/65802
439/607.01

* cited by examiner

ELECTRICAL CONNECTOR PLUG AND CONDUCTIVE WIRE AND ASSEMBLY PROVIDED WITH THE SAME

FIELD OF THE INVENTION

The present invention relates to an electrical connector plug and conductive wire and an assembly provided with the same, and more particularly, to an electrical connector plug adapted for the Universal Serial Bus (USB) interface.

BACKGROUND OF THE INVENTION

To increase the flexibility of 3C products (computers/communications/consumer products), various external devices can be connected using multi-media slots provided on the 3C products, to support devices such as external hard drives, portable disks or memory sticks (collectively referred to herein as USB drives), multi-media video and audio equipment, keyboards and so forth, so as to functional expansion of the 3C product. However, when 3C products initially came to rise, manufacturers designed various proprietary specifications for the transmission or communication interfaces for their own external devices. For example, many printers can only be connected to LPT ports, many MODEMs can only be connected to RS232 ports, certain types of mice and keyboards can only be connected to PS/2 ports, and so on. Moreover, different interface specifications require the installation of corresponding drivers and then rebooting the 3C products prior to use. Consequently, the external device must be compatible with the transmission interface of the 3C product. This can be the source of great inconvenience for the user. In addition, this introduces manufacturing difficulties for 3C product developers and accessory manufacturers.

The USB interface supports the convenient features of hot swapping and plug-and-play. This means that 3C products can be plugged/unplugged without powering off, which will not damage the host or USB device. Moreover, the USB protocol supports detection and use of newly plugged-in external devices in real time. Additionally, USB transmission speeds are much higher than those of traditional standard buses, such as a parallel ports (e.g. EPP, LPT) and serial ports (e.g. RS-232). Therefore, the USB interface has now become a popular and widely accepted specification.

To date, the development of the USB technology has gone through three major phases, from 1.0 to 3.0, and it is somewhat troublesome to change and maintain the USB socket built into the computer host. The USB 3.0 plug provides an engaging terminal on both sides. Inserted in either way, it can be electrically connected to the socket, which improves upon conflicting structural design on both sides. In this way, USB 3.0 expects to provide a more fool-proof design and avoid the damage of USB sockets due to a user's incorrect plugging or over-forcing of the plug. According to the current design, the electrically conductive terminals in the USB socket have a resilient structure. After the USB plug is connected to the socket, the resilient electrically conductive terminals in the USB socket are pressed back by the engaging terminals of the USB plug, and elastically abut against the engaging terminals. In this way, the electrical connection between the USB socket and USB plug is kept stable.

However, the resilient electrically conductive terminals may suffer from elastic fatigue, over-forcing or over-displacement, which can interrupt the electrical connection between the contact terminals and the resilient electrically conductive terminals. Powered-off or short-circuited USB device obviously cannot work effectively, which is, again, a source of great inconvenience to users. Moreover, many external devices are used collaboratively, such as multi-media video & audio equipment, keyboard and external hard drives, which must work together. In case of malfunction of the USB socket, users must resort to plugging and unplugging the external device again and again to maintain operations. Worse, this repeated plugging/unplugging operation may damage the external device more easily, and so users should be more cautious.

To maintain a convenient and hassle-free use, most users choose to change to a new USB socket. However, it is quite difficult for users to change the USB socket by themselves, which typically requires disassembling the 3C product and checking the motherboard. For most common users, who are unfamiliar with the internal structure of 3C products, they can only return the product to the manufacturer to change the USB socket, and this may take several days. Nowadays, people rely on 3C products so much that they may become annoyed if so much time is wasted on a small component, which introduces unwanted delays in their work or entertainment.

Because of the maintenance inconvenience related to USB sockets, manufacturers place a great emphasis on protecting them. With the current trend in which all electronic gadgets are made light, slim, short and small, the USB 3.0 is more compact than the previous USB 1.0 and 2.0, and looks like a mini or micro USB port. Yet, the number of terminals in USB 3.0 greatly exceed that of mini USB and micro USB. Unavoidably, the resilient electrically conductive terminals of USB 3.0 are still the core components susceptible to damage.

SUMMARY OF THE INVENTION

The invention seeks to provide an electrical connector plug and conductive wire and an assembly provided with the same. Resilient, electrically conductive terminals are mounted on a USB plug so as to improve its weakness. Further, various embodiments take advantage of the metallic shield frame to protect the structural strength of the USB plug and to support the contact terminals, so as to prevent structural damage due to excessive pressure. The technology of this case reduces the probability of malfunction on contact terminals. Even if they are accidentally damaged, a user can change them easily, so as to save time and manpower wasted by returning a device to the manufacturer for maintenance.

Hence, various embodiments provide an electrical connector plug and conductive wire and an assembly provided with the same, which mounts the vulnerable resilient electrically conductive terminals on the USB plug to solve problems currently existing in the art, such as the difficulty of changing USB ports and the waste of time in doing so.

Another purpose of various embodiments is to provide an electrical connector plug and conductive wire and an assembly provided with the same, which adds a metallic shield frame onto the USB plug to provide additional protection for vulnerable contact terminals. Excessive external forces are absorbed by the metallic shield frame, so as to reduce the probability of damaging the structure of the resilient contact terminals due to such external forces.

It is still another purpose of certain embodiments of the invention to provide an electrical connector plug and conductive wire and an assembly provided with the same, which adds a metallic shield frame onto the USB plug to provide crosstalk protection.

To achieve these and other purposes, various embodiments include an electrical connector plug with resilient contact terminals adapted for an electrical connection socket, wherein the electrical connector socket includes a casing and at least two groups of engaging terminals mounted on the casing. The electrical connector plug comprises an electrically conductive housing, a coupling device mounted on the electrically conductive housing and extending in a longitudinal direction, having a base portion, at least two groups of resilient contact terminals mounted on the coupling device and axially symmetrical to each other in the longitudinal direction, with each of the resilient contact terminals having a flat section secured at least in part in the base portion of the coupling device and an upwardly protruding contact section extending from and bending towards the flat section. The flat sections are parallel to one another and the respective upwardly protruding contact sections are adapted to abut against a corresponding one of the engaging terminals of the electrical connector socket. A metallic shield frame electrically is connected to and secured to the electrically conductive housing, with the metallic shield frame having a frame section, a front section, and two lateral protective sections extending from two ends of the front section and connected to the frame section. The respective lateral protective sections have a height no less than that of the upwardly protruding contact sections of the resilient contact terminals.

The electrical connector plug is connected to at least one end of a connecting wire, namely, a conductive wire, which is for electrical connection to an electrical connector socket having a casing and at least two groups of engaging terminals mounted in the casing. The conductive wire has at least one electrical connector plug, and a wire electrically connected to the electrical connector plug. The electrical connector plug has an electrically conductive housing, a coupling device mounted in the electrically conductive housing and extending in a longitudinal direction and comprising a base portion. At least two groups of resilient contact terminals are mounted on the coupling device and are axially symmetrical to each other in the longitudinal direction. Each of the resilient contact terminals has a flat section secured at least in part in the base portion of the coupling device and an upwardly protruding contact section extending from and bending towards the flat section. The flat sections are parallel to one another and the respective upwardly protruding contact sections are adapted to abut against a corresponding one of the engaging terminals of the electrical connector socket. A metallic shield frame is electrically connected to and secured to the electrically conductive housing, with the metallic shield frame having a frame section, a front section, and two lateral protective sections extending from the two ends of the front section and connected to the frame section. The respective lateral protective sections have a height no less than that of the upwardly protruding contact sections of the resilient contact terminals.

The electrical connector plug together with the socket provide an electrical connector assembly, and includes an electrical connector socket having a casing and at least two groups of engaging terminals mounted in the casing, and an electrical connector plug electrically connected to the electrical connector socket, having: an electrically conductive housing; a coupling device mounted in the electrically conductive housing and extending in a longitudinal direction, and having a base portion, with at least two groups of resilient contact terminals mounted in the coupling device and axially symmetrical to each other in the longitudinal direction. Each of the resilient contact terminals has a flat section secured at least in part in the base portion of the coupling device and an upwardly protruding contact section extending from and bending towards the flat section. The flat sections are parallel to one another and the respective upwardly protruding contact sections are adapted to abut against a corresponding one of the engaging terminals of the electrical connector socket. A metallic shield frame is electrically connected to and secured to the electrically conductive housing, with the metallic shield frame having a frame section, a front section, and two lateral protective sections extending from the two ends of the front section and connected to the frame section. The respective lateral protective sections have a height no less than that of the upwardly protruding contact sections of the resilient contact terminals.

The electrical connector plug and conductive wire and an assembly provided with the same disclosed herein mounts the resilient electrically conductive terminals of the USB socket on the USB plug, and provides a metallic shield frame to support the resilient contact terminals, preventing elasticity loss due to excessive pressure. In this way, various embodiments provide additional protection for the resilient contact terminals on the USB plug, so that they are not easily damaged. Even if the USB is damaged accidentally, the user does not have to take the host device in for repair, but just needs to change the spare USB accessories, or even only the conductive wire. In this respect, the structure improves upon a significant weakness in previous USB sockets and increases durability, eliminating manufacturer repair troubles for users.

BRIEF DESCRIPTION OF THE DRAWINGS

The foregoing and other features and advantages of illustrated embodiments of the present invention will be more readily apparent from the following detailed description, which proceeds with reference to the accompanying drawings.

DETAILED DESCRIPTION OF THE ILLUSTRATED EMBODIMENTS

Figure 1:
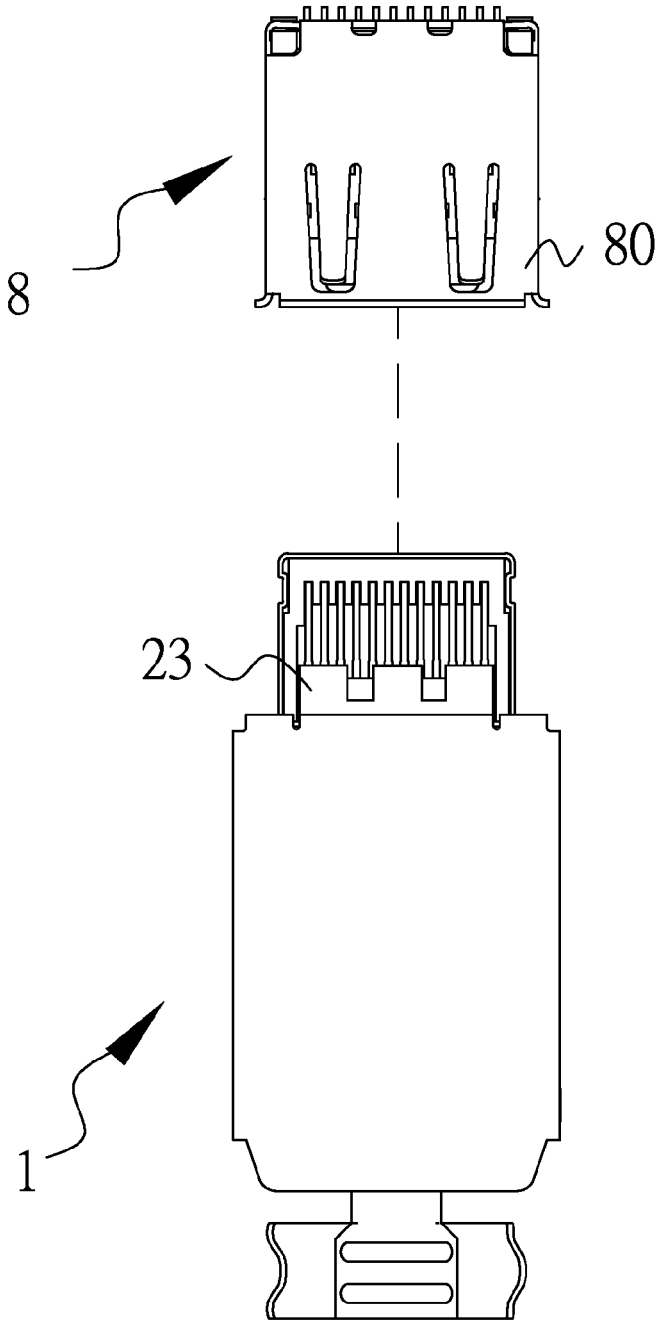
FIG. 1 is the schematic diagram of an electrical connector plug and conductive wire and an assembly provided with the same according to a first embodiment of the invention.
Figure 2:
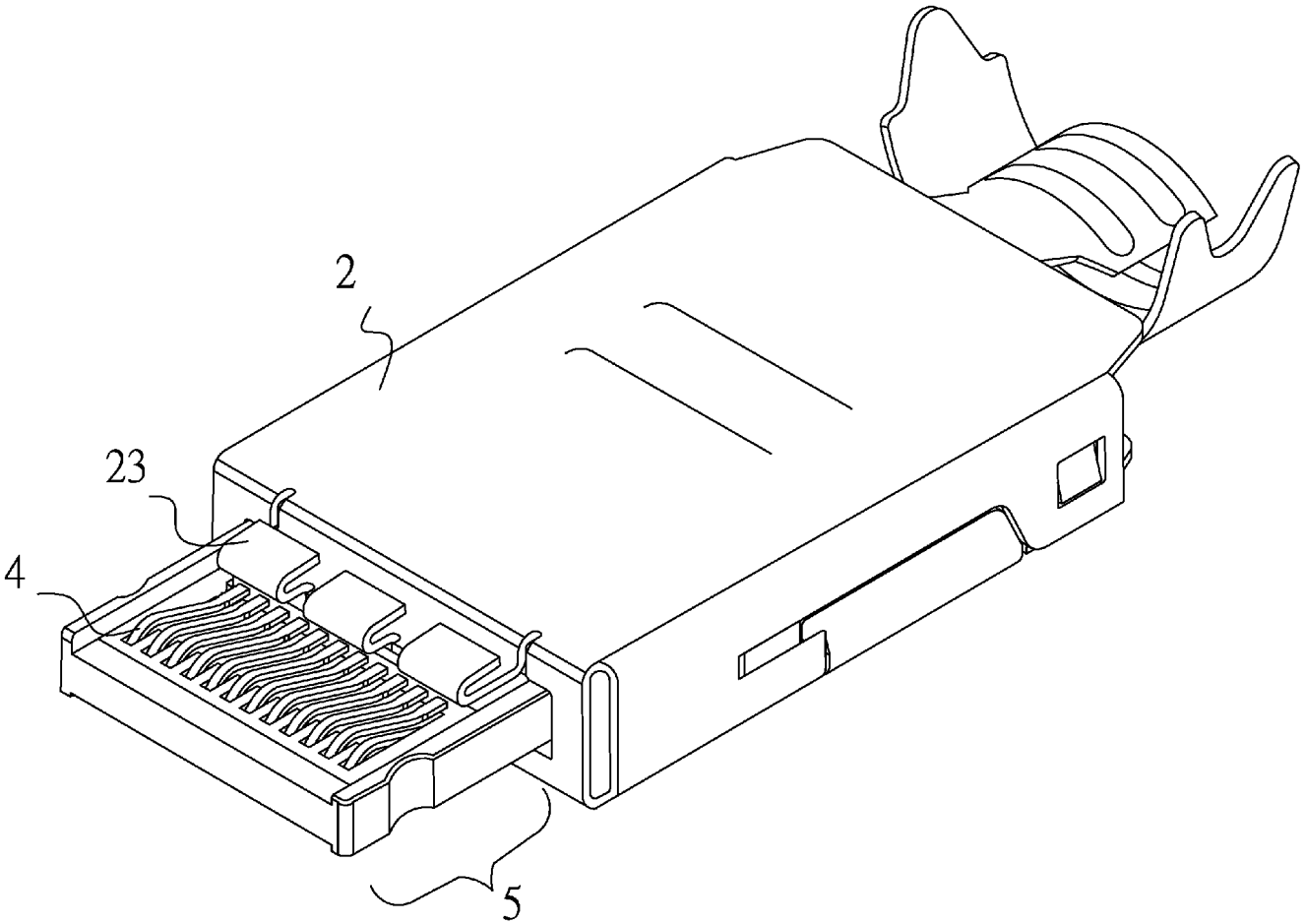
FIG. 2 is a perspective view of the electrical connector plug shown in FIG. 1.
Figure 3:
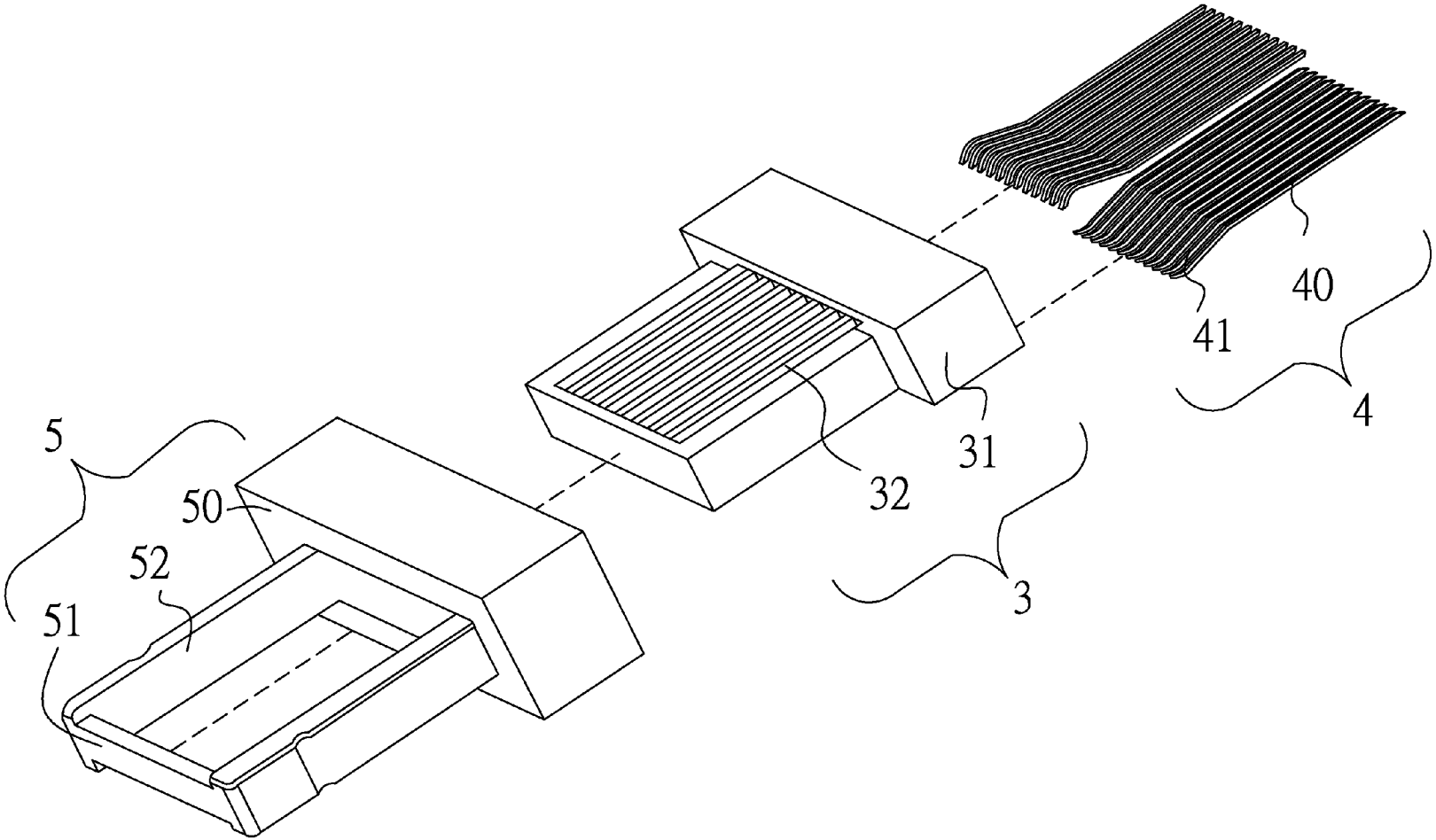
FIG. 3 is an exploded view of the electrical connector plug shown in FIG. 1.

The above statements related to the invention, other technical contents, features and benefits will be clearly presented in the detailed illustration for the preferred embodiments as shown in the diagrams. Similar assemblies in these embodiments will be represented by similar symbols.

The first embodiment illustrates an electrical connector assembly by way of example, as shown in Figure F-6. The electrical connector assembly is a USB connector assembly in this embodiment, including an electrical connector socket 8 which is a USB socket and an electrical connector plug 1 which is a USB plug. One electrically conductive lip 23 extends from an electrically conductive housing 2 of the electrical connector plug 1, which is for electrical connection of the casing 80 to the electrical connector socket 8. When the electrical connector plug 1 is coupled to the electrical connector socket 8, their metallic shells are electrically connected. The electrical connector socket 8 can be mounted on the housings of various 3C products, and connects to the motherboard of these 3C products. Therefore, the electrical connection between the electrically conductive section 51 and the shell of the 3C products will provide grounding and shielding effects. In this way, the electrical signal transmitted by the terminals between the electrical connector socket 8 and the electrical connector plug 1 are not be easily impacted by external electromagnetic radiation.

Figure 4:
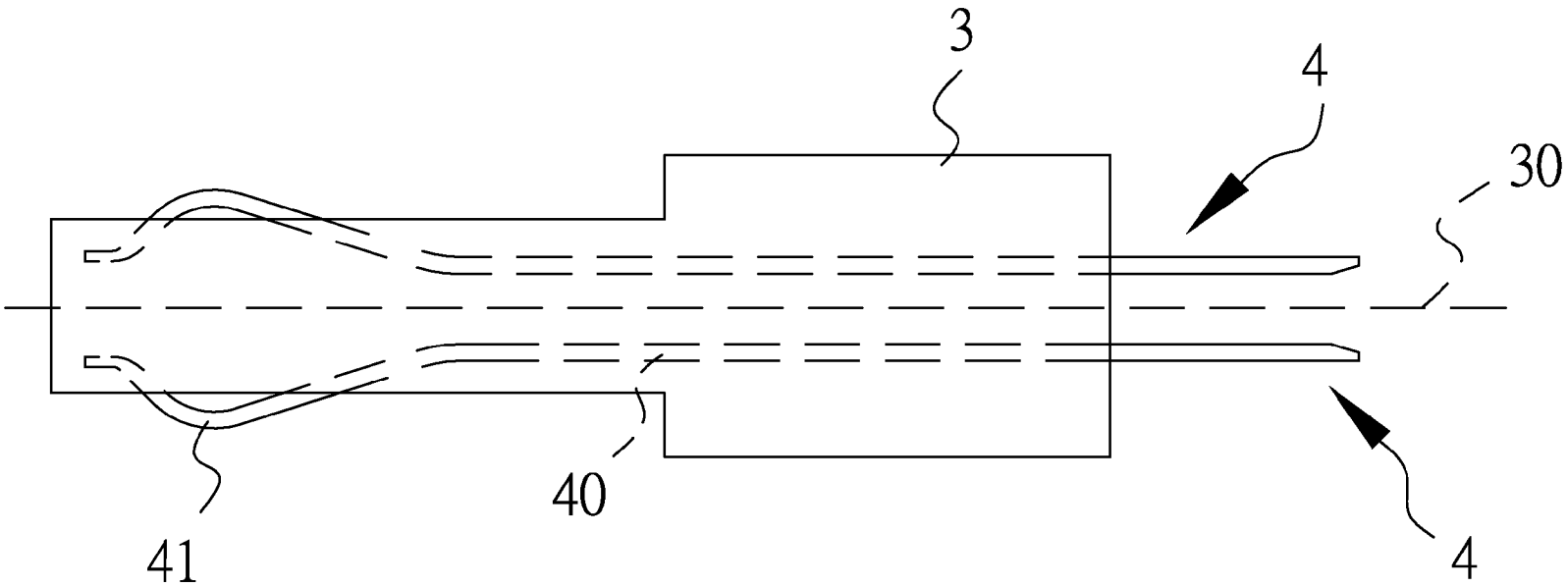
FIG. 4 is a side view of an embodiment electrical connector plug, illustrating resilient contact terminals of the USB 3.0 connector.
Figure 5:
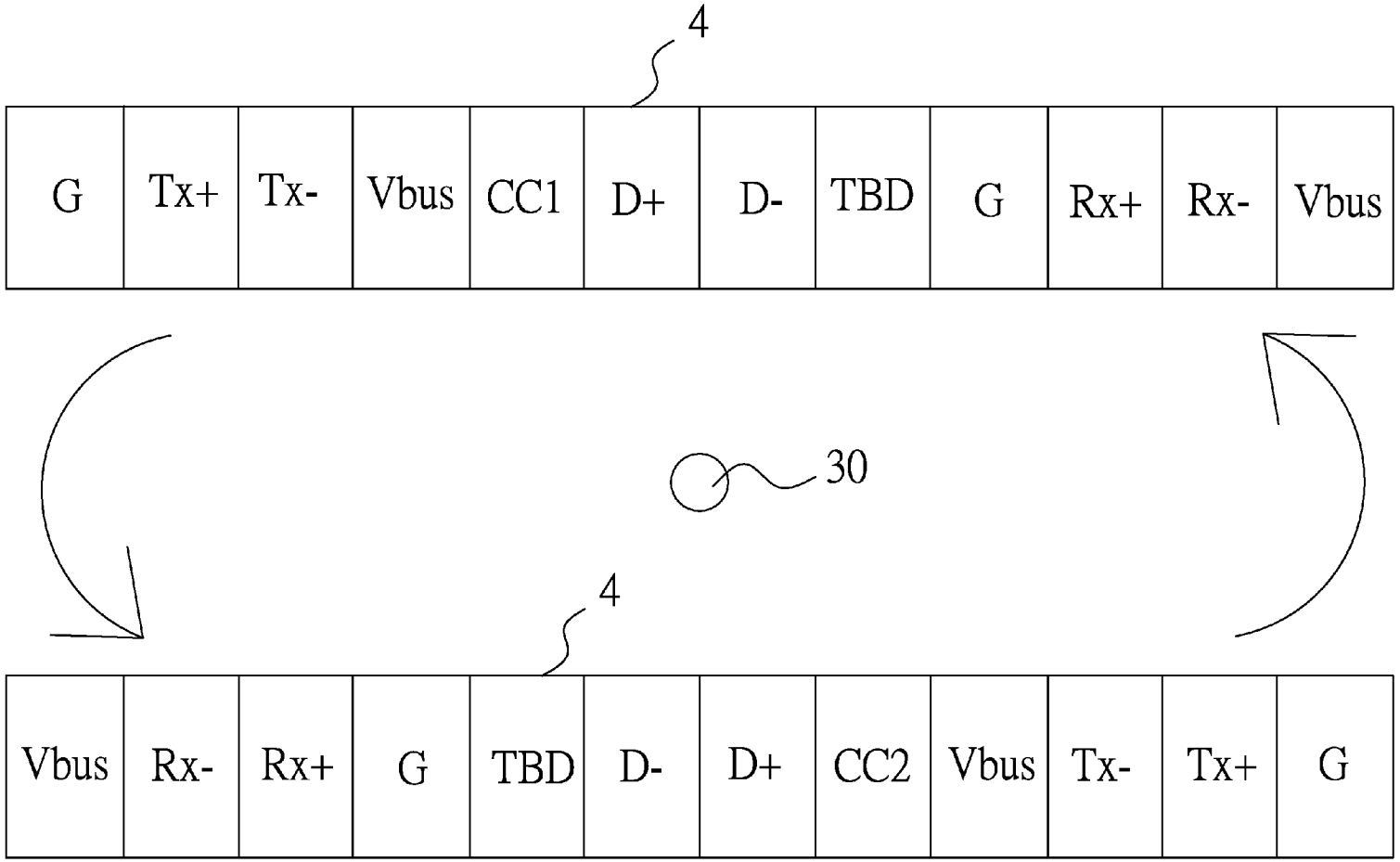
FIG. 5 is a front view of embodiment resilient contact terminals, illustrating an axially symmetrical arrangement of the resilient contact terminals.
Figure 6:
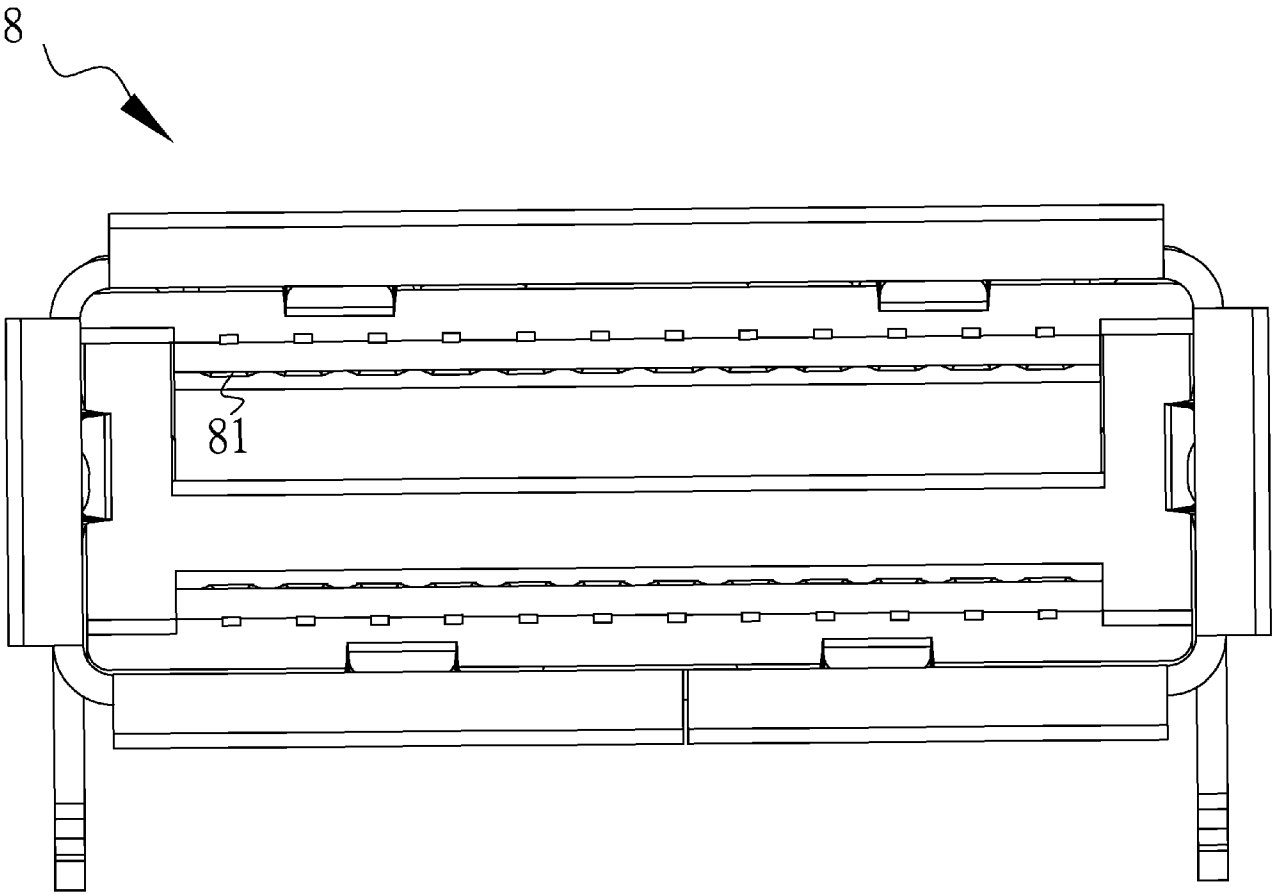
FIG. 6 is a front view of an electrical connector socket.

The electrical connector plug 1 includes a coupling device 3 that extends along a longitudinal direction 30 and that is coupled to the electrically conductive housing 2. As shown in FIG. 4, there are two groups of resilient contact terminals 4 that extend along longitudinal direction 30 as a central axis, and which are mounted on the coupling device 3. As shown in FIG. 5, the two groups of secured resilient contact terminals 4 are symmetrical to one another, wherein either group of resilient contact terminals 4 will be completely overlapped with another group by rotating 180 degrees with the lateral longitudinal direction 30 as the axis of rotation. For the purpose of clarity and illustration herein, the term axial symmetry along the longitudinal direction 30 is used to define the mounting position of the two groups of resilient contact terminals 4.

The resilient contact terminals 4, which are axially symmetrical to one another, are mounted on the coupling device 3. Each of the resilient contact terminals 4 has a flat section 40 and an upwardly protruding contact section 41 extending from and bending towards the flat section 40. The coupling device 3 comprises a base portion 31 and a plurality of guide grooves 32 formed in the base portion 31. The flat sections 40 of the resilient contact terminals 4 are secured in part on the base portion 31. The plurality of guide grooves 32 are used to receive the flat sections 40 of the resilient contact terminals 4, so as to prevent crossing of the flat sections 40 that could otherwise cause short circuiting.

The metallic shield frame 5 in the electrical connector plug 1 includes a frame section 50, a front section 51, and two lateral protective sections 52 extending from the two side ends of the front section 51 and are connected to the frame section 50. The frame section 50, the front section 51, and these two lateral protective sections 52 can reduce the probability of electromagnetic interference between different connectors. The sidewall protective sections 52 of the metallic shield frame 5 each have a height that is no less than that of the front section 51, and the height of the front section 51 is lower than that of the upwardly protruding contact sections 41 of the resilient contact terminals 4.

When the electrical connector plug 1 is connected to the electrical connector socket 8, engaging terminals 81 of the electrical connection socket 8 will go through the front section 51 with a lower height, so as to abut against and electrically connect with the resilient contact terminals 4 of the electrical connector plug 1. In case of over-forcing by a user, the resilient contact terminals 4 could be damaged during the plug/unplug process of the electrical connector plug 1. However, because of the lateral protective sections 52 of the metallic shield frame 5, whose respective heights are not less than that of the upwardly protruding contact sections 41 of the resilient contact terminals 4, this excessive force will be offset or absorbed by the lateral protective sections 52, and so it will not further impinge upon the resilient contact terminals 4, thus preventing damage to the resilient contact terminals 4 due to elastic fatigue.

The above structure transfers the vulnerable resilient contact terminals to the electrical connector plug, and does not have a great impact on the electrical connection between the electrical connector plug and the electrical connector socket. It costs less to change an electrical connector plug than an electrical connector socket. The resilient contact terminals are transformed into consumable parts, which can be changed by the user in the event that they are damaged. In this way, the user does not have to wait a long time for repair of a 3C device.

Figure 7:
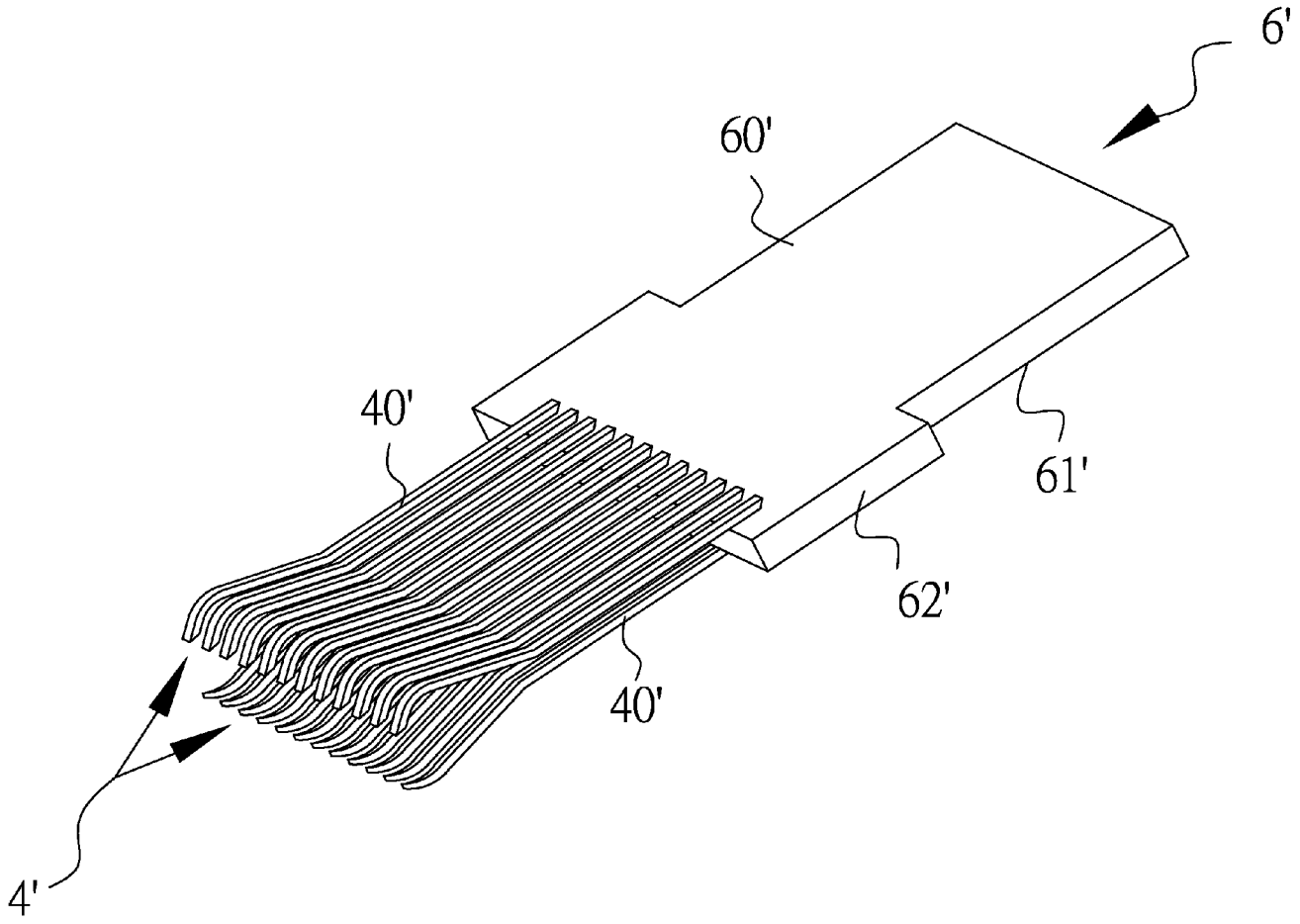
FIG. 7 is a perspective view of the electrical connector plug and conductive wire and an assembly provided with the same according to a second embodiment of the invention, illustrating resilient contact terminals welded to a circuit board.
Figure 8:
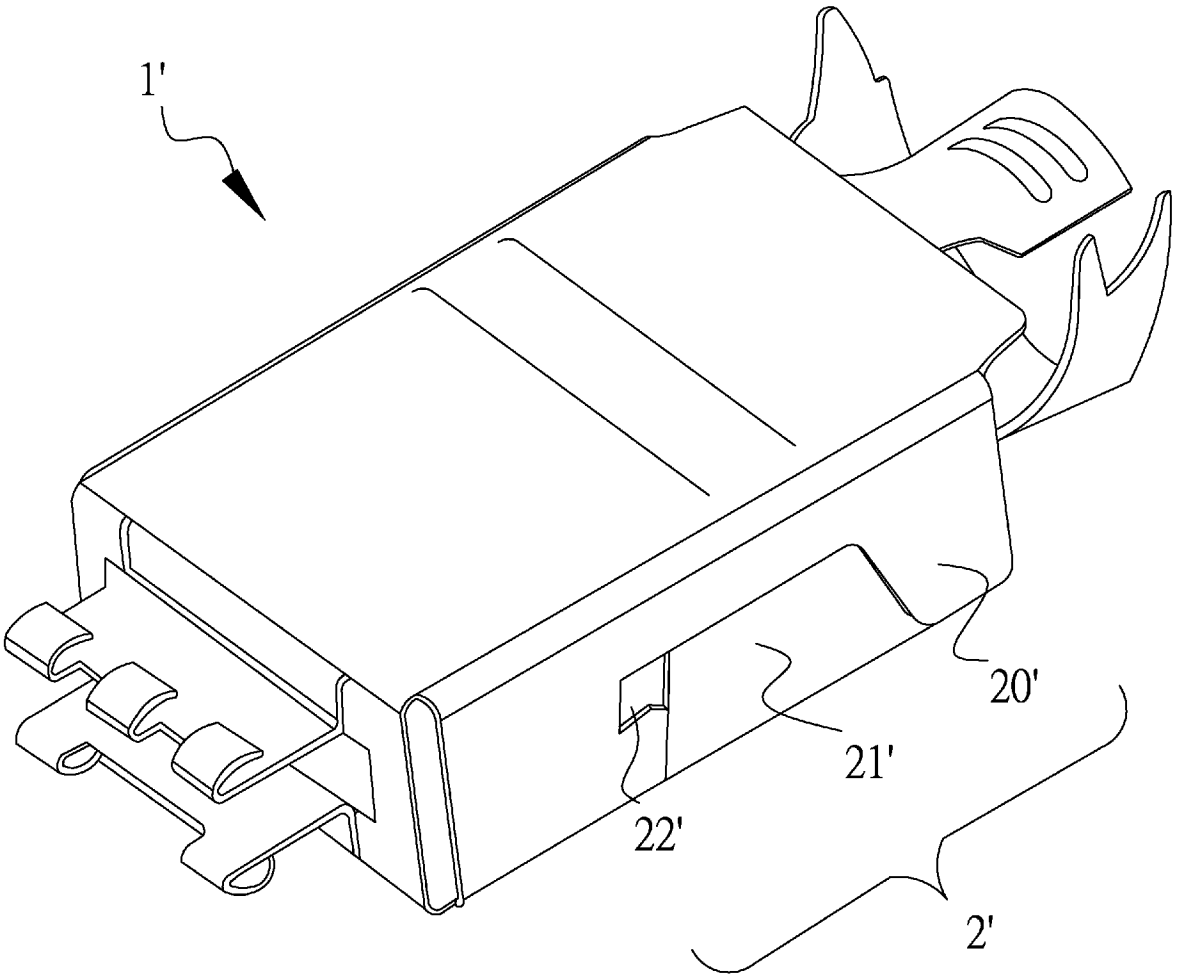
FIG. 8 is a perspective view of an electrical connector plug and conductive wire and an assembly provided with the same according to a second embodiment of the invention, illustrating a welded point between a circuit board and upper and lower housings of an electrically conductive housing.

The second embodiment takes an electrical connector assembly as an example, as shown in FIGS. 7 and 8. The coupling device in this embodiment is a circuit board 6' having a front side 60', a back side 61' and two lateral sides 62' connecting the front side 60' to the back side 61'. Bonded onto a portion of the front side 60' and the back side 61', such as by laser welding or the like, are portions of flat sections 40' of two groups of resilient contact terminals 4', which are axially symmetrical to each other as shown in the first embodiment. The two groups of resilient contact terminals 4' are secured on the front side 60' and the back side 61' respectively, and so they maintain their axially symmetrical arrangement, and receive the flat sections 40', so as to prevent crossing of the flat sections 40 that may otherwise cause short circuiting.

An electrically conductive housing 2' also includes an upper housing 20' and a lower housing 21', each being formed with two welded spots 22', and wherein the welded spots 22' are formed in a manner corresponding to the two lateral sides 62' of the circuit board 6', so that the upper housing, the lower housing and the circuit board are welded together. In this way, the overall strength of the electrical connector plug 1' is increased. If the operator drops the electrical connector plug 1', the structure of the electrically conductive housing 2' will not be loosened or damaged due to the collision impact from falling on the ground.

Figure 9:
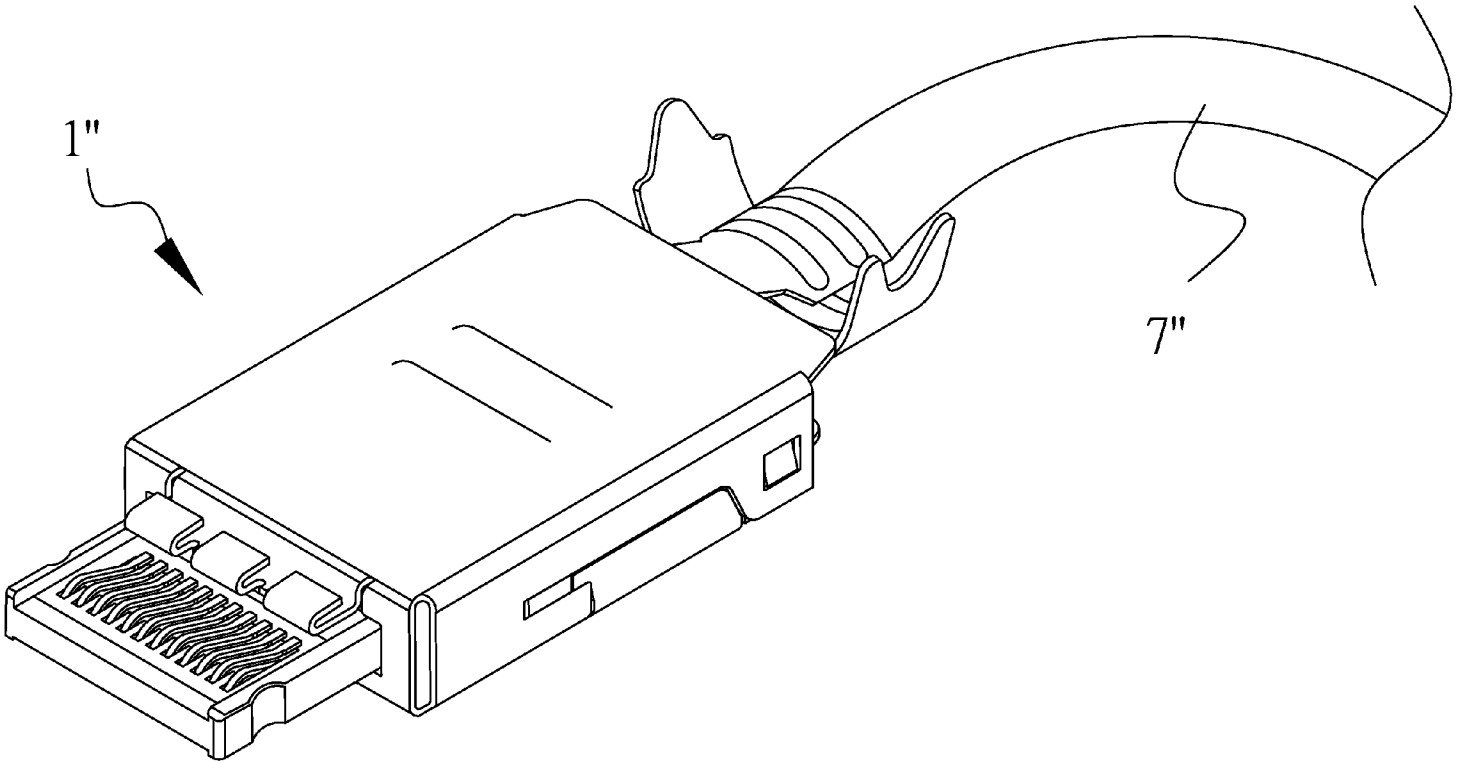
FIG. 9 is a perspective view of an electrical connector plug and conductive wire and an assembly provided with the same according to a third embodiment of the invention, illustrating connection between the electrical connector plug and related assemblies, such as the conductive wires.

Those of reasonable skill in the art will readily understand that the electrical connector plug in any embodiment can work with the related modules simultaneously, such as a conductive wire. A third preferred embodiment provides a conductive wire adapted for the electrical connector, as shown in FIG. 9. As long as the circuit board (not shown in the figure) of the electrical connector plug 1" connects with the flat sections (not shown in the figure) of the resilient contact terminals (not shown in the figure) on one end, and connects with the electrically conductive wire 7" on the other end, it will form a conductive wire adapted for the electrical connector.

Various embodiments of the electrical connector plug and conductive wire and an assembly provided with the same allow the user to transmit files more easily. The user does not have to plug/unplug the electrical connector plug in a particular way. Plugged/unplugged in either orientation (up or down), the electrical connector plug can be connected/disconnected easily, which increases the convenience of use. Moreover, by mounting the resilient contact terminals on the electrical connector plug, together with the metallic shield frame formed by a metallic casing, resistance to pressure from external forces is increased, the structural strength of the electrical connector plug is increased and the probability of crosstalk is reduced. This structure changes the resilient contact terminals into consumable parts, so that users can change them by themselves, saving the time and expense spent of otherwise taking a product in for repair.

While the invention has been described with reference to the preferred embodiments above, it should be recognized that the preferred embodiments are given for the purpose of illustration only and are not intended to limit the scope of the present invention, and that various modifications and changes, which will be apparent to those skilled in the relevant art, may be made without departing from the spirit and scope of the invention.

What is claimed is:

1. An electrical connector plug provided with resilient contact terminals and adapted for electrical connection to an electrical connector socket having a casing and at least two groups of engaging terminals mounted in the casing, the electrical connector plug comprising:

an electrically conductive housing;

a coupling device mounted in the electrically conductive housing and extending in a longitudinal direction, the coupling device comprising a base portion;

at least two groups of resilient contact terminals mounted in the coupling device and axially symmetrical to each other about the longitudinal direction, each of the resilient contact terminals comprising a flat section secured at least in part to the base portion of the coupling device and an upwardly protruding contact section extending from the flat section, wherein the flat sections are parallel to one another and the respective upwardly protruding contact sections are adapted to abut against at least a corresponding engaging terminal of the electrical connector socket; and a metallic shield frame electrically connected to and secured to the electrically conductive housing, the metallic shield frame comprising a frame section, a front section having two ends, and two lateral protective sections respectively extending from the two ends of the front section and connected to the frame section, wherein the respective lateral protective sections each have a height no less than that of the upwardly protruding contact sections of the resilient contact terminals.

2. The electrical connector plug provided with resilient contact terminals according to claim 1, wherein the electrically conductive housing is provided with at least one electrically conductive lip for electrical connection to the casing of the electrical connector socket as the electrical connector plug is coupled to the electrical connector socket.

3. The electrical connector plug provided with resilient contact terminals according to claim 1, wherein the coupling device is a circuit board for electrical connection to the flat sections of the resilient contact terminals, and wherein the circuit board includes a front side, a back side and two lateral sides connecting the front side to the backside.

4. The electrical connector plug provided with resilient contact terminals according to claim 3, wherein the electrically conductive housing comprises an upper housing and a lower housing, each being formed with at least a welded spot, and wherein each welded spot is formed in a manner corresponding to one of the two lateral sides of the circuit board, so that the upper housing, the lower housing and the circuit board are welded together.

5. The electrical connector plug provided with resilient contact terminals according to claim 1, wherein the height of each lateral protective section of the metallic shield frame is no less than that of the front section to provide protection to the upwardly protruding contact sections of the resilient contact terminals.

6. The electrical connector plug provided with resilient contact terminals according to claim 1, wherein the base portion of the coupling device is formed with a plurality of guide grooves to receive the flat sections of the resilient contact terminals.

7. The electrical connector plug provided with resilient contact terminals according to claim 1, wherein the plug is conformal to a universal serial bus plug.

8. The electrical connector plug provided with resilient contact terminals according to claim 1, wherein the metallic shield frame is produced by metallic casting, so that the electrical connector plug has increased structural strength.

9. A conductive wire for electrical connection to an electrical connector socket having a casing and at least two groups of engaging terminals mounted in the casing, the conductive wire comprising:

at least one electrical connector plug; and at least a wire electrically connected to the at least one electrical connector plug;

wherein the at least one electrical connector plug comprises:

an electrically conductive housing;

a coupling device mounted in the electrically conductive housing and extending in a longitudinal direction, the coupling device comprising a base portion;

at least two groups of resilient contact terminals mounted in the coupling device and axially symmetrical to each other about the longitudinal direction, each of the resilient contact terminals comprising a flat section secured at least in part to the base portion of the coupling device and an upwardly protruding contact section extending from the flat section, wherein the flat sections are parallel to one another and the respective upwardly protruding contact sections are adapted to abut against a corresponding one of the engaging terminals of the electrical connector socket; and a metallic shield frame electrically connected to and secured to the electrically conductive housing, the metallic shield frame comprising a frame section, a front section having two ends, and two lateral protective sections respectively extending from the two ends of the front section and connected to the frame section, wherein the respective lateral protective sections each have a height no less than that of the upwardly protruding contact sections of the resilient contact terminals.

10. An electrical connector assembly comprising:

an electrical connector socket comprising a casing and at least two groups of engaging terminals mounted in the casing; and an electrical connector plug electrically connectable to the electrical connector socket, comprising:

an electrically conductive housing;

a coupling device mounted in the electrically conductive housing and extending in a longitudinal direction, the coupling device comprising a base portion;

at least two groups of resilient contact terminals mounted in the coupling device and axially symmetrical to each other about the longitudinal direction, each of the resilient contact terminals comprising a flat section secured at least in part to the base portion of the coupling device and an upwardly protruding contact section extending from the flat section, wherein the flat sections are parallel to one another and the respective upwardly protruding contact sections are adapted to abut against at least one corresponding engaging terminal of the electrical connector socket; and a metallic shield frame electrically connected to and secured to the electrically conductive housing, the metallic shield frame comprising a frame section, a front section having two ends, and two lateral protective sections respectively extending from the two ends of the front section and connected to the frame section, wherein the respective lateral protective sections each have a height no less than that of the upwardly protruding contact sections of the resilient contact terminals.

* * * * *